US005884331A

United States Patent [19]

Barajas

[11] Patent Number: 5,884,331

[45] Date of Patent: Mar. 23, 1999

[54] COMBINED SEAT CUSHION AND PERSONAL COVER

[76] Inventor: Kathleen Barajas, 550 W. 6th St., #3, San Bernardino, Calif. 92310

[21] Appl. No.: 963,912

[22] Filed: Nov. 4, 1997

Related U.S. Application Data

[60] Provisional application No. 60/043,257 Apr. 10, 1997.

[51] Int. Cl.[6] ..... A41D 3/08; A41D 15/00

[52] U.S. Cl. ..... 2/69; 2/88; 2/94

[58] Field of Search ..... 2/94, 69, 69.5, 2/88, 89, 1; 5/413 R, 494, 485; 383/4, 6, 127; 190/1

[56] References Cited

U.S. PATENT DOCUMENTS

| | | |
|---|---|---|
| D. 293,868 | 1/1988 | Paletta et al. . |
| D. 332,546 | 1/1993 | Waltner . |
| D. 342,638 | 12/1993 | Harland . |
| 2,109,951 | 3/1938 | Truesdell et al. . |
| 2,420,344 | 5/1947 | Alexander . |
| 2,783,473 | 5/1957 | Humpler . |
| 2,791,775 | 5/1957 | Sartell . |
| 2,967,306 | 1/1961 | Fabanich . |
| 4,116,310 | 9/1978 | Shields . |
| 4,370,755 | 2/1983 | Crumby . |
| 4,597,605 | 7/1986 | Gilbert . |
| 4,598,725 | 7/1986 | Brewer . |
| 4,822,309 | 4/1989 | Vandenberg . |
| 5,206,958 | 5/1993 | Widenback . |
| 5,346,308 | 9/1994 | Buhot et al. . |
| 5,370,460 | 12/1994 | Nelson . |
| 5,414,881 | 5/1995 | Terrazas . |
| 5,454,125 | 10/1995 | Ratkowski . |
| 5,463,783 | 11/1995 | Pope . |
| 5,481,767 | 1/1996 | Lewis . |
| 5,533,653 | 7/1996 | Kaufman . |
| 5,611,083 | 3/1997 | Arnold . |
| 5,618,110 | 4/1997 | Sullivan . |
| 5,629,071 | 5/1997 | Feldman . |
| 5,735,004 | 4/1998 | Wooten et al. . |
| 5,787,504 | 8/1998 | Wu . |

FOREIGN PATENT DOCUMENTS

| | | |
|---|---|---|
| 527667 | 10/1940 | United Kingdom . |
| 1 264 919 | 2/1972 | United Kingdom . |
| 2 626 152 | 7/1989 | United Kingdom . |

*Primary Examiner*—Michael A. Neas
*Assistant Examiner*—Shirra L. Jenkins
*Attorney, Agent, or Firm*—Richard C. Litman

[57] ABSTRACT

A multi-purpose device for use as a protective weather resistant hooded poncho, blanket, pillow or seat cushion. The device has a rectangular planar body, to which a hood is attached. The hood stores in an attached pouch, which also forms a second pouch. The entire planar body may be folded and stored within the second pouch. The second pouch envelopes the planar body after the second pouch is inverted. Carrying straps of various types, including a vest, may be used to transport the stored device. Reflective indicia may be included to increase visibility for safety purposes.

14 Claims, 5 Drawing Sheets

40
12
28
14

40
50
28
12
14

40
50
28

40
50
12

40
90
50

COMBINED SEAT CUSHION AND PERSONAL COVER

CROSS-REFERENCE TO RELATED APPLICATION

This application claims the benefit of U.S. Provisional Patent Application Ser. No. 60/043,257 filed on Apr. 10, 1997.

BACKGROUND OF THE INVENTION

1. Field of the Invention

The present invention relates to a hooded outer garment that may also be converted for use as a blanket, or folded into an attached pocket for use as a seat cushion or pillow. Furthermore, with use of appropriate fabrics and patterns, the device may also be used to maximize visibility for safety.

2. Description of Related Art

Active people often find themselves in places where they must be prepared for many situations. Weather is a common concern to most active people, whether they be camping, picnicking, or at: a ball game. Since storage space is at a premium, all necessities must be packed tightly. To avoid bringing many articles that nay turn out to be unneeded, it is advantageous to have one item with several uses.

For example, bleachers or other seating arrangements are often uncomfortable, so a seat cushion will be needed. Moreover, even the sunniest of days can turn sour in a moments notice, so rain gear is always a must. In cooler weather, or where temperature ranges fluctuate, it is further necessary to provide warm coverings, that may easily be removed. When picnicking, a blanket is needed to spread out the afternoon's delights. Many things are needed to insure a safe and comfortable time.

By the time the family and all needed items are loaded into the car, it is packed full. For this reason, any items that may be combined into a single package must be used. The need therefore exists for an easily transported and carried article that will function as rain gear, warmer outer wear, a blanket, a pillow, a seat cushion, and even provide safety features.

Previous attempts have been made to combine articles for convenient storage and transport. Among these attempts is U.S. Pat. No. 5,414,881 issued to Terrazas on May 16, 1995, disclosing a combination stadium blanket/waterproof covering and cushion. A rectangular sheet having one side waterproofed, including a hood may be used as a blanket or rain covering. A pocket in provided for storage of the hood. The sheet nay be folded a number of times and used as a seat cushion.

U.S. Pat. No. 5,454,125, which issued to Ratkowski on Oct. 3, 1995, discloses a self-contained comfort device having a generally rectangular body portion and two pocket members disposed on opposite surfaces of the body portion, for containing the device when the device is folded and the pocket member :is inverted thereabout. The device also includes a resilient pad.

Other multipurpose articles are known, but do not relate to water resistant combination articles. These include U.S. Pat. No. 5,481,767 multi-purpose beach blanket) which issued to Lewis on Jan. 9, 1996; U.S. Pat. No. 5,370,460 (recreational/play mat-convertible to a totable storage bag) which issued to Nelson on Dec. 6, 1994; U.K. patent document 527,667 (rug or blanket which can be converted into a bag) dated Oct. 14, 1940; U.K. patent document 1,264,919 (cushions) published Feb. 23, 1970; French patent document 2,626,152 dated Jan. 22, 1988 disclosing a foldable game board and attached storage pouch.

Other patented devices related to poncho-type devices are known, but are less related to the present invention, including U.S. Pat. No. 4,370,755 (combination poncho and cushion) issued to Crumby on Feb. 1, 1983, and U.S. Pat. No. 5,206,958 (protection suit comprising a poncho-like part and a protective hood joined thereto and a method of manufacturing the same) issued to Widenback on May 4, 1993.

Other combination devices are known, but less related to the present invention, including U.S. Pat. No. 4,822,309 (combined life preserver cushion and tote bag) issued to Vandenberg on Apr. 18, 1989; U.S. Pat. No. 4,116,310 (combined shoulder strap bag and cushion) issued to Shields on Sep. 26, 1978; U.S. Pat. No. Des. 342,638 (combined bingo bag kit and seat cushion) issued to Harland on Dec. 20, 1993; U.S. Pat. No. Des. 293,868 (combined cushion and carrying bag) issued to Paletta et al. on Jan. 26, 1988; U.S. Pat. No. 4,597,605 (combined tote bag and seat cushion) issued to Gilbert on Jul. 1, 1986; and U.S. Pat. No. Des. 332,546 (combined stadium bag and seat) issued to Waltner on Jan. 19, 1993.

None of the above inventions and patents, taken either singly or in combination, is seen to describe the instant invention as claimed.

SUMMARY OF THE INVENTION

Accordingly, it is a principal object of the invention to provide a multi-purpose device that functions as a weather resistant poncho, blanket, pillow or seat cushion.

It is another object of the invention to provide a multi-purpose device that folds into a convenient package.

It is a further object of the invention to provide a multi-purpose device that has high visibility safety features.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

In accordance with the above-listed objects, the present invention is a multi-purpose device that functions as a weather resistant poncho, blanket, and seat cushion. Through a series of folds and tucks, the device is converted from one item to another for different purposes. In its expanded form, the device serves as a poncho, having a planar body, a hood, and a dual compartment pouch. The planar body has two surfaces. An inner surface is designed for comfort and, in alternative embodiments, warmth. An outer surface is designed to protect the wearer from the elements, and is waterproof. A hood also has these features. The hood is attached to the planar body, and stored in the first of two pouches. The second pouch, formed by the material of the first pouch and the inner surface of the planar body, is inverted to envelope the planar body, after folding, for storage. In this stored state, the device functions as a pillow or seat cushion.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
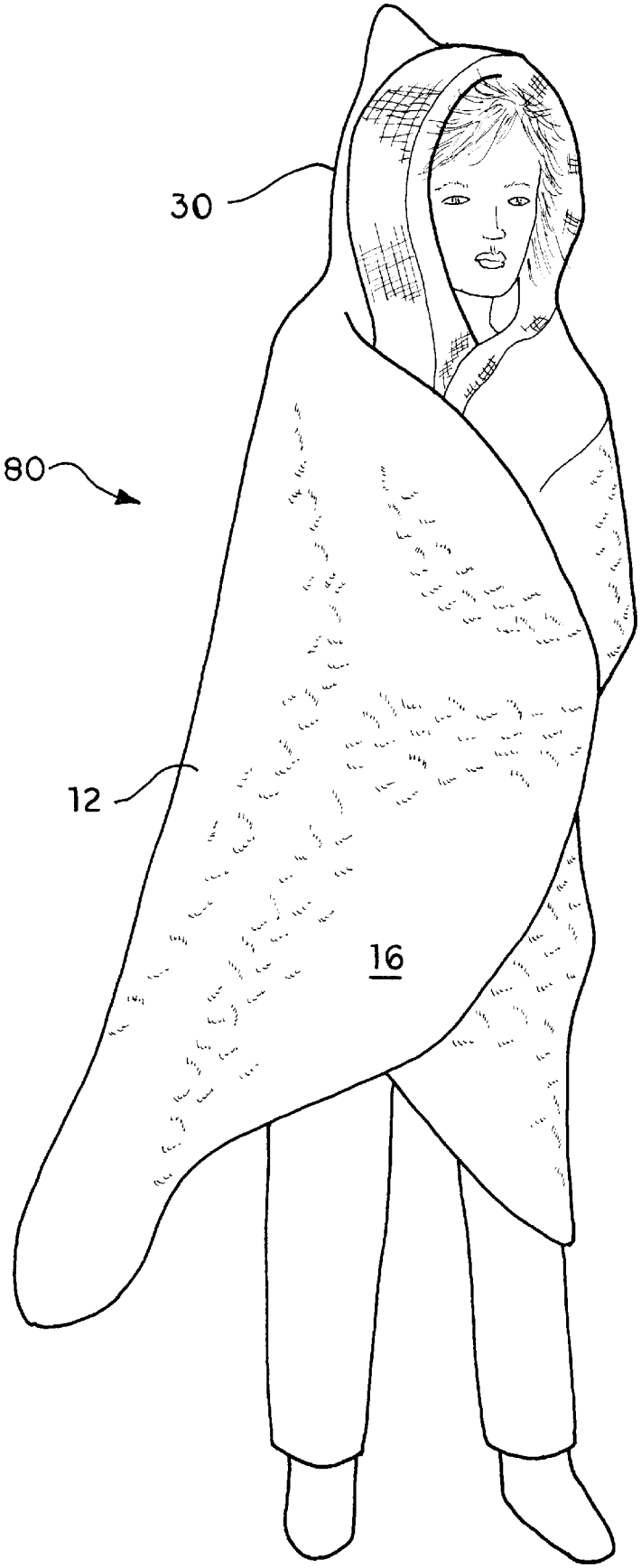
FIG. 1 is an environmental view of the device, fully expanded and in use.

Referring now to the figures by numerals of reference, a multi-purpose device of the present invention is shown. The device, in its fully expanded form, as shown in FIG. 1, may be used as a hooded poncho 80. As can be appreciated, the device in this manner may also function as protective rain gear or warming outer wear. The device may be converted to a blanket and even a compact cushion 90 or pillow.

Figure 2:
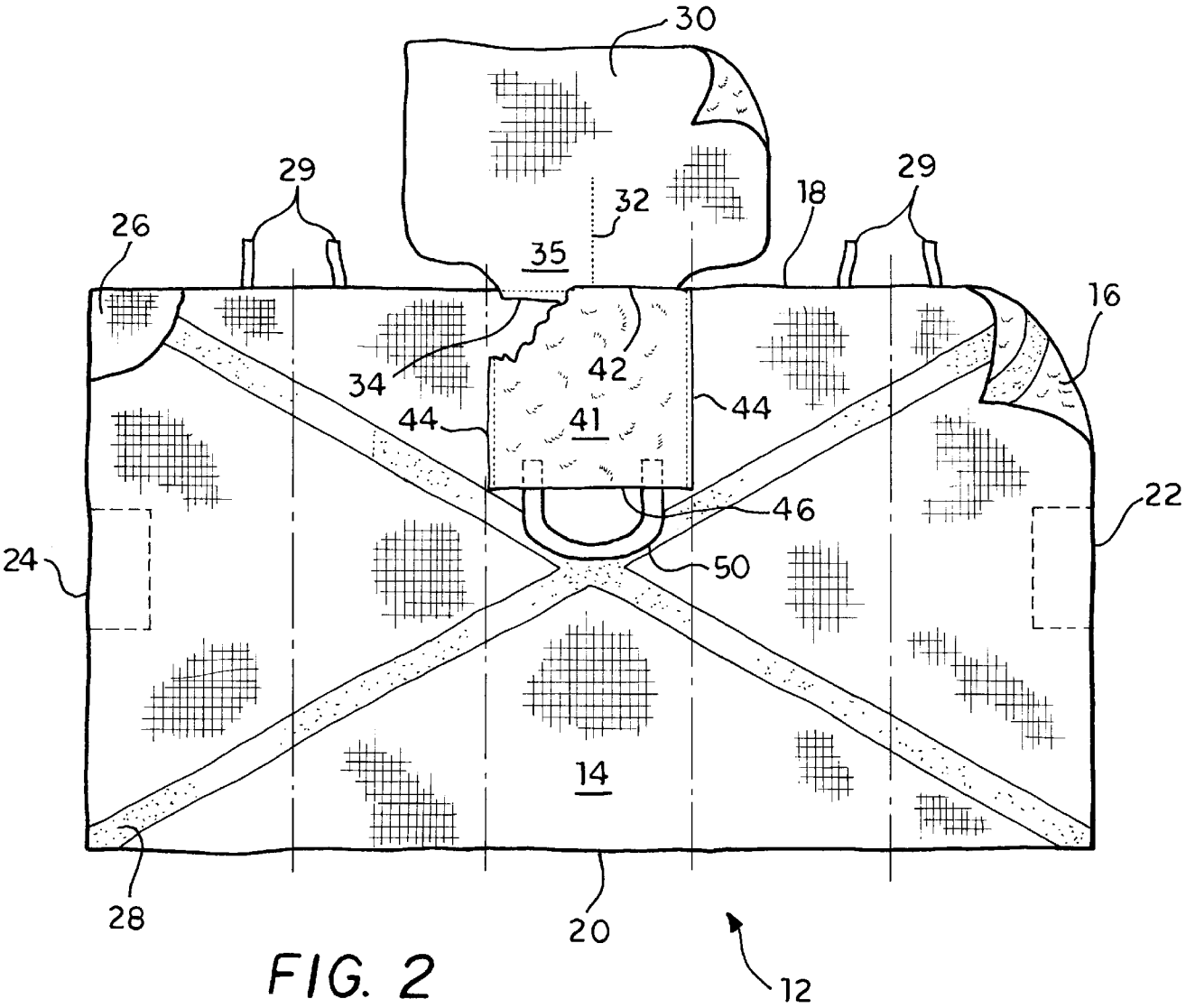
FIG. 2 is a predominantly front elevational view of the device, fully expanded, with turned corners.

As seen throughout the Figures, and especially in FIG. 2, the device has a rectangular planar body 12, a hood 30, and a specially designed dual compartment pouch 40. The planar body 12 and hood 30 are used to shield the wearer from the elements. The special pouch 40 is designed to hold the hood 30 when not in use, as well as to store the entire planar body 12 creating pillow or seat cushion 90.

The planar body 12 has two surfaces. The two surfaces are created by the joining of two sheets of fabric. An inner surface 14 may be made from any fabric material, and is chosen for comfort. The inner surface 14 may be adapted for use in various weather conditions and may be made from a variety of fabrics, from light weight cotton to fleece. An outer surface 16 is meant to offer protection from the elements, and as such is preferably waterproof. The planar body 12 is bounded by an upper edge 18, a lower edge 20, a right edge 22, and a left edge 24. The upper and lower edges 18, 20 are preferably parallel, and met at right angles by the right and left edges 22, 24 thus forming four corners. In each the upper right and left hand corners, is a corner pocket 26 with an opening angled toward the center of the planar body 12. These pockets 26 serve the dual purpose of keeping the wearer's hands warm, and giving the wearer a place to grab hold of the device to wrap it around the body. Ties 29 may also be provided to secure the device about the wearer.

The planar body 12 may optionally be provided with indicia on either or both surfaces 14, 16. The indicia may be used as purely decoration such as a team logo. A logo may even be placed on the pouch 40 so that it shows when the device is used as a seat cushion 90. Reflective fabrics 28 or surfaces also may be used to provide high visibility for safety purposes. This may be especially useful if the wearer is walking at night after car troubles, or even after getting lost on a camping trip. The reflective indicia 28 will preferably be located on both surfaces 14, 16 of the planar body 12 and be in the form of a large X.

The hood 30 is simply made from a rectangular section having two surfaces matching that of the planar body 12. The hood 30 is stitched along section line 32 at the longitudinal midpoint for a short distance, approximately eight inches, from and perpendicular to a lower edge 34. This stitch line eventually corresponds in position to the back of the head and neck of the wearer and defines a line of weakness about which the hood 30 will more easily form to conform to the head of a wearer so as to act as a hood.

A central portion 35, approximately fifteen inches long, forms a tongue along the hood 30 is attached at the midpoint of the upper edge 18 of the planar body 12. As shown in FIG. 1 in use, any excess material which extends forward of the face is folded inward to form return bend, thereby creating a more decorative appearance of the hood, and the corners of which are manually held from beneath the device so as to prevent the hood 30 from unfolding.

The specially designed dual compartment pouch 40 holds the hood 30 when not in use, and stores the entire planar body 12 within the pouch 40, thereby creating a pillow or seat cushion 90. The pouch 40 is created from a folded rectangular sheet 41 of material, having two short ends 42 and two long sides 44. One short end 42 of the sheet is attached to the planar body 12, along the same stitch line of the hood 30. The remaining short end 42 is folded upward to meet the first. Both long sides 44 are stitched upon themselves and to the planar body 12. In this manner, a first pouch is formed opening upwards, for receiving the hood 30, having a closed bottom made by the fold 46 in the material. A second pouch, opening downward toward the center of the planar body 12, is also defined by the inner surface 14 of planar body 12 and the folded rectangular sheet 41 of the first pouch.

Several means may be used to aid in carrying the stored device, as seen in FIGS. 5–8. Two handles 50, a single shoulder strap 52, a backpack-type shoulder harness 54, or even a vest 56 may be used. Regardless of which type is used, each is attached such that it is exposed when the device is stored, and hidden within the pouch 40 when the device is expanded.

In a preferred embodiment, the entire device may be constructed from a standard sixty inch wide six foot length of fabric. Preferred dimensions for the planar body 12 would be 72 inches wide by 40 inches. Preferred dimensions for the hood 30 would be 38 inches wide by 15 inches. The sheet 41 of fabric used to create the dual compartment pouch 40 would preferably have dimensions of 34 inches wide by 17 inches, before folding. The remaining fabric may be used to make either securing ties 29 or carrying straps, or both.

Figure 3:
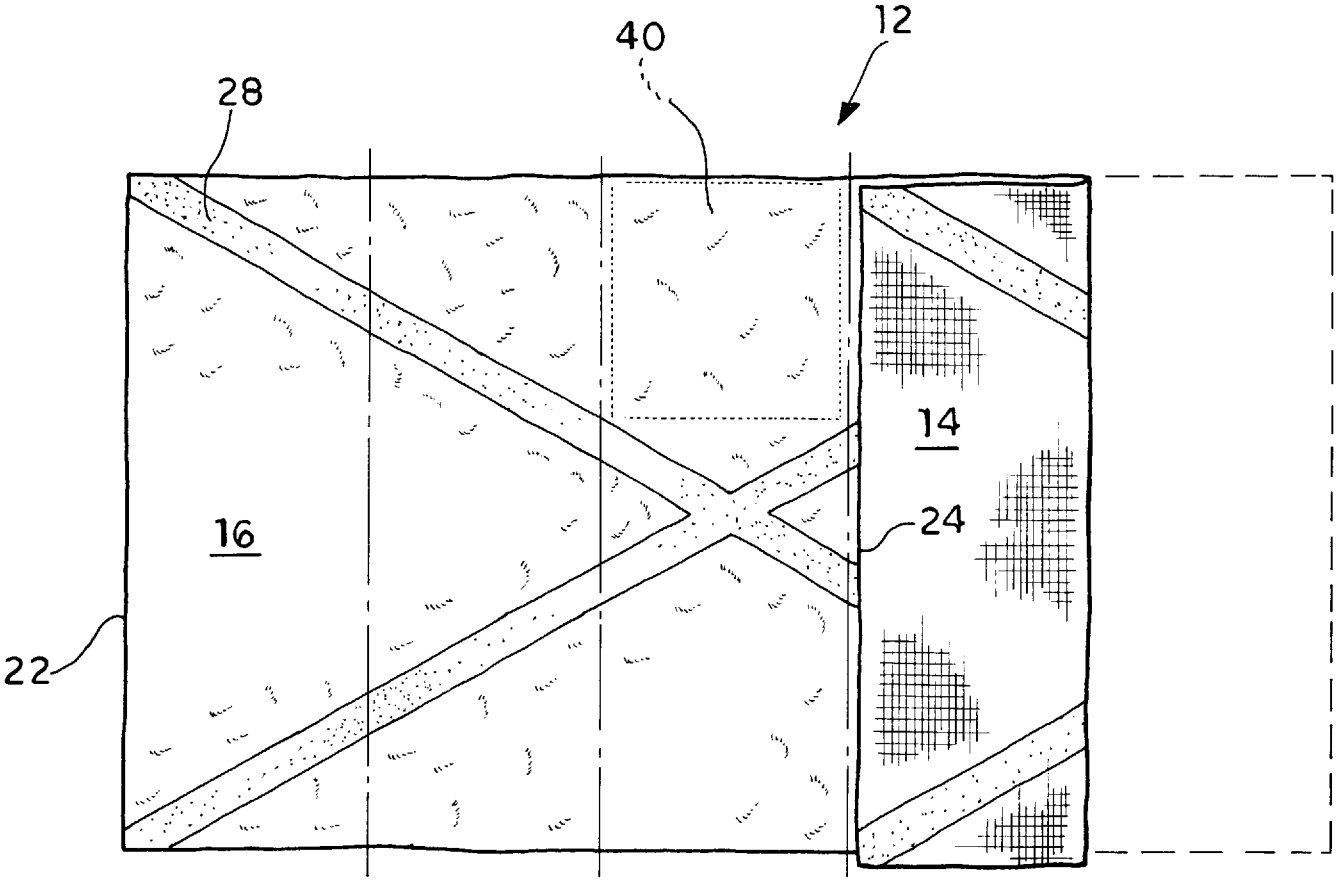
FIG. 3 is a predominantly rear elevational view of the device, showing a state of the device partially folded and hood stored.
Figures 4A, 4B, 4C, 4D, 4E:
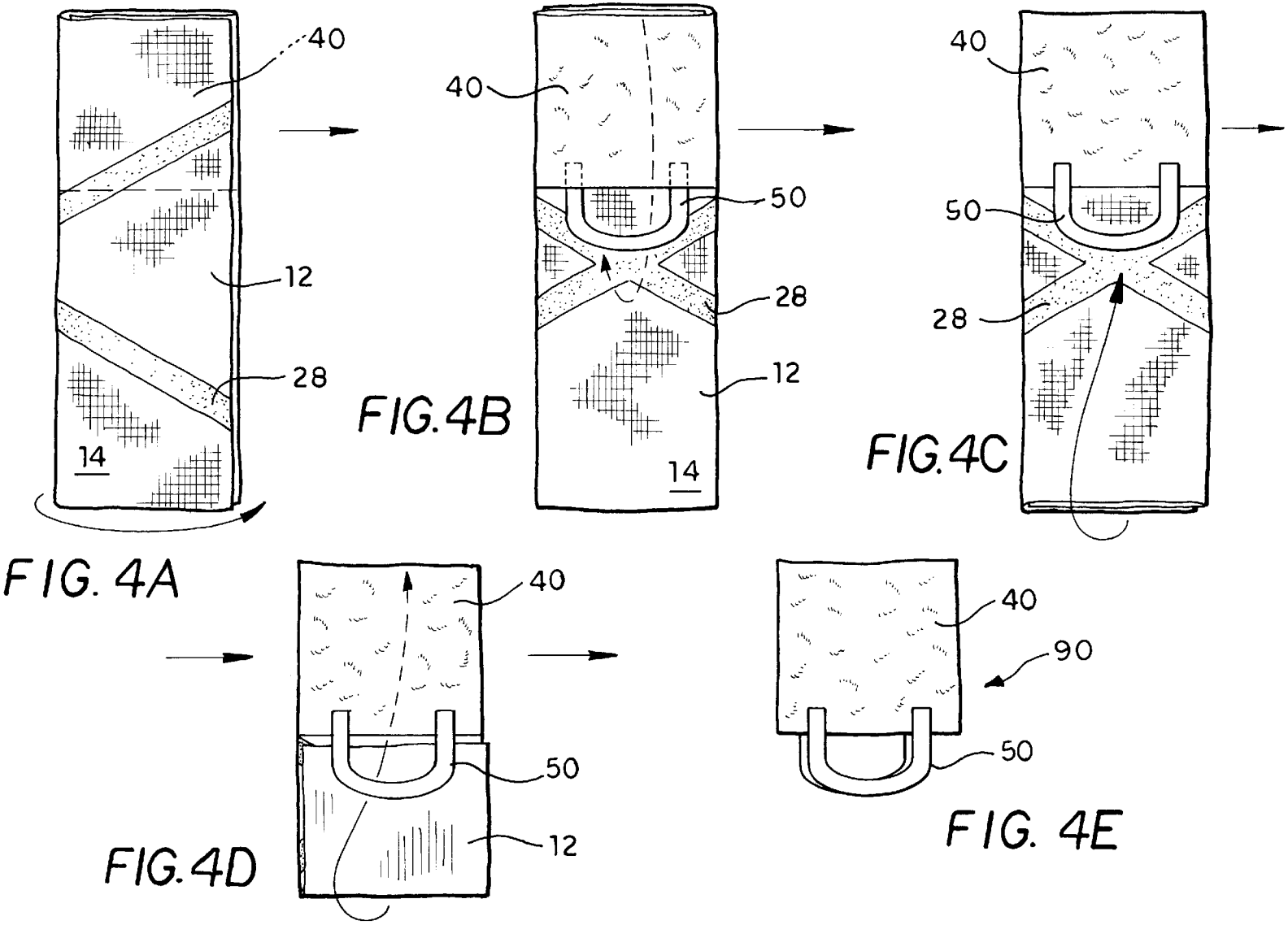
FIGS. 4 A, 4B, 4C, 4D, and 4E are elevational views of the device, illustrating a sequence of folds needed to store the device.
Figure 6:
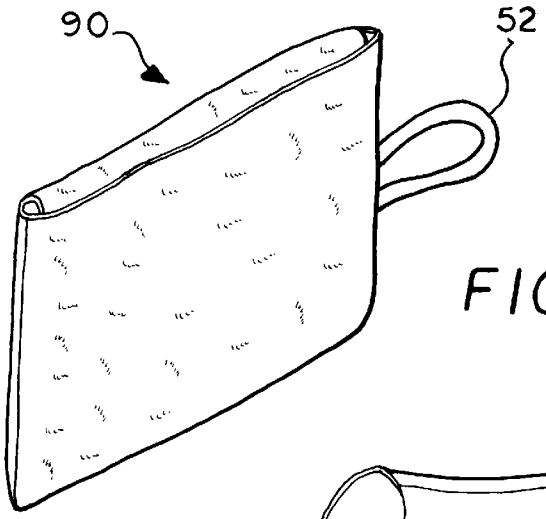
FIG. 6 is a perspective view of a second alternative embodiment of the stored device having a shoulder strap.
Figure 8:
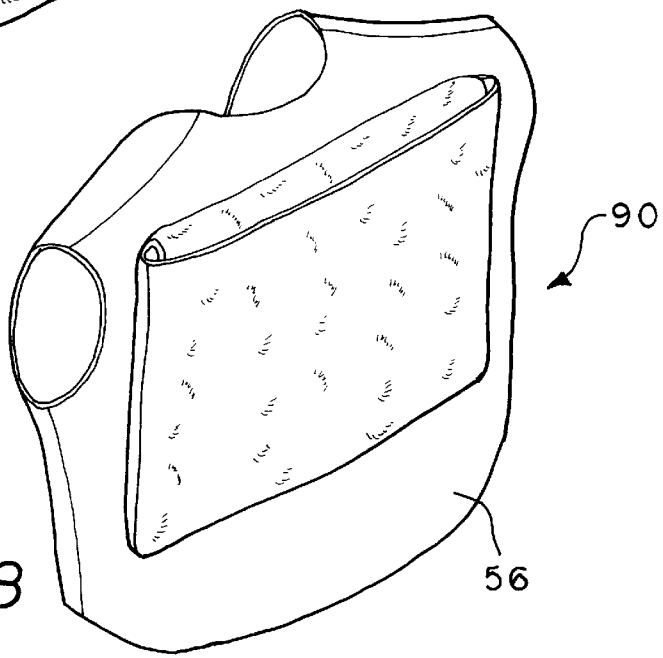
FIG. 8 is a perspective view of a fourth alternative embodiment of the stored device having a vest.
Figure 5:
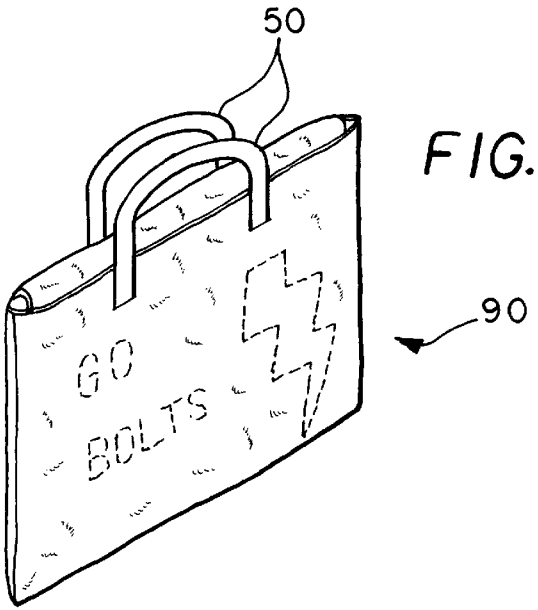
FIG. 5 is a perspective view of a first alternative embodiment of the stored device having two handles.
Figure 7:
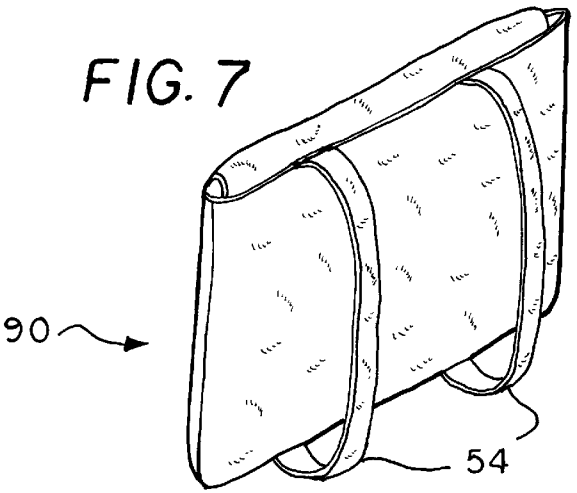
FIG. 7 is a perspective view of a third alternative embodiment of the stored device having a backpack-type shoulder harness.

Converting the device from a weather protective poncho 80 to a seat cushion is simply done by following a sequence of folds and tucks. First, the device must be opened flat, with hood 30 stored, outer surface 16 facing up (pouch down) as seen in FIG. 3. Then the right and left edges 22, 24 are folded toward the center, folding twice on each side, until a single column of fabric remains, as seen in FIG. 4A. The device is then flipped, so that the pouch 40 now faces up, as seen in FIG. 4B. It is important to note that the handles 50 are attached to what is now the inside of the pouch 40, and that the loose folds of the planar body 12 are exposed along the entire length. Now, as shown in FIG. 4B, the pouch 40 is inverted, i.e. turned inside out, thereby concealing the upper loose folds of the planar body 12 while exposing the handles 50, as seen in FIG. 4C. The remaining portion of the planar body 12 is then folded upward twice, and tucked in the pouch 40. In this manner, the pouch 40 envelopes the planar body 12, securing all loose edges and folds into a convenient seat cushion 90, as shown in FIG. 4E.

It is to be understood that the present invention is not limited to the embodiments described above, but encompasses any and all embodiments within the scope of the following claims.

I claim:

1. A multi-purpose device, comprising:

a. a flexible planar rectangular body having i. an upper edge, a parallel lower edge, a right edge and a left edge, wherein said right and left edges meet the upper and lower edges at right angles thereby forming four corners;

ii. an inner surface made of a first material;

iii. an outer surface made of a second material;

iv. a corner pocket, in each of said corners formed by the intersection of said upper edge with said right and left edges, wherein said pocket opens toward the center of said planar body;

b. a hood member, attached to said planar body along said upper edge midway between said right and left edges;

c. a dual-compartment pouch comprising i. a rectangular sheet of material, having two short ends and two long sides, attached along one of said short ends to said inner surface of said planar body such that the location of said hood member and of said short end coincide;

ii. wherein said sheet is folded, with short ends meeting along said upper edge of said planar body and attached to said body along said long sides thereby forming a first pouch, opening upward for receiving said hood member, and a second pouch, opening downward, formed by the folded rectangular sheet and said inner surface of said planar body, such that said planar body may be enveloped, when folded, by inverting said second pouch; and d. a means for carrying said device, when stored, attached within said second pouch for exposure when said second pouch is inverted.

2. The multi-purpose device as recited in claim 1, wherein said first material is a fabric liner.

3. The multi-purpose device as recited in claim 2, wherein said first material is fleece.

4. The multi-purpose device as recited in claim 2, wherein said first material is cotton.

5. The multi-purpose device as recited in claim 1, wherein said second material is waterproof.

6. The multi-purpose device as recited in claim 1, wherein:

a. said first material is a fabric liner; and b. said second material is waterproof.

7. The multi-purpose device as recited in claim 1, wherein said means for carrying said device includes a pair of handles attached to said second pouch such that when said second pouch is inverted said handles may be used to carry the stored device.

8. The multi-purpose device as recited in claim 1, wherein said means for carrying said device includes a shoulder strap attached to said second pouch such that when said second pouch is inverted said shoulder strap may be used to carry the stored device.

9. The multi-purpose device as recited in claim 1, wherein said means for carrying said device includes shoulder harnesses attached to said second pouch such that when said second pouch is inverted said shoulder harnesses may be used to carry the stored device.

10. The multi-purpose device as recited in claim 1, wherein said means for carrying said device includes a vest attached to said second pouch such that when said second pouch is inverted said vest may be used to carry the stored device.

11. The multi-purpose device as recited in claim 1, wherein indicia may be applied to said outer surface of said planar body.

12. The multi-purpose device as recited in claim 1, wherein indicia may be applied to said inner surface of said planar body, such that when said device is stored, said indicia is displayed.

13. The multi-purpose device as recited in claim 1, wherein indicia may be applied a. to said outer surface of said planar body; and b. to said inner surface of said planar body, such that when said device is stored, said indicia is displayed.

14. The multi-purpose device as recited in claim 1, wherein said inner and outer surfaces include reflective material designed to aid in visibility.

* * * * *